United States Patent [19]

Moschovis et al.

[11] 4,097,391

[45] * Jun. 27, 1978

[54] LIQUID DEVELOPER FOR ELECTROPHOTOGRAPHIC OFFSET MASTERS

[75] Inventors: Elias P. Moschovis; John L. Gilson, both of Morton Grove, Ill.

[73] Assignee: A. B. Dick Company, Niles, Ill.

[ * ] Notice: The portion of the term of this patent subsequent to Dec. 6, 1994, has been disclaimed.

[21] Appl. No.: 625,773

[22] Filed: Oct. 24, 1975

[51] Int. Cl.[2] ..... G03G 9/12

[52] U.S. Cl. ..... 252/62.1 L; 96/1 LY; 101/451; 101/452; 106/2; 252/62.1 R; 544/106

[58] Field of Search ..... 252/62.1 L, 62.1 R; 96/1 LY; 101/452, 451; 427/17; 106/2; 260/247

[56] References Cited

U.S. PATENT DOCUMENTS

| | | | |
|---|---|---|---|
| 3,417,019 | 12/1968 | Beyer | 252/62.1 L |
| 3,625,897 | 12/1971 | Machida et al. | 252/62.1 L |
| 3,793,234 | 2/1974 | Ormsbee | 252/62.1 |
| 3,844,966 | 10/1974 | Nelson | 252/62.1 L |
| 3,939,087 | 2/1976 | Vijayendran | 252/62.1 L |

*Primary Examiner*—Mayer Weinblatt
*Assistant Examiner*—John D. Smith
*Attorney, Agent, or Firm*—McDougall, Hersh & Scott

[57] ABSTRACT

A liquid composition for development of latent electrostatic images formed on an offset master for use in the production of multiple copies by offset duplication, in which the developer composition is formulated to contain a fatty acid amine, aromatic amine, heterocyclic amine or other aliphatic amine containing from 3 to 18 carbon atoms in the aliphatic group to obviate the undesirable effects from treatment of the imaged surface with a conversion solution.

8 Claims, No Drawings

LIQUID DEVELOPER FOR ELECTROPHOTOGRAPHIC OFFSET MASTERS

This invention relates to the production of copy by electrophotographic technique, using an electrostatic planographic master having a coating of photoconductive zinc oxide or other photoconductive particulate in an organic resinous binder, and it relates more particularly to a liquid developer composition for use in imaging the electrophotographic master.

As described in U.S. Pat. No. 2,987,395 and U.S. Pat. No. 3,001,872, a master sheet is fabricated of a base element of metal, plastic, paper or the like having a photoconductive zinc oxide - resinous binder coating which has the desired photoconductive properties for the development of a latent electrostatic image by electrostatic technique. When such latent electrostatic image is developed by a developer in which the toner is ink receptive and water repellent, to define the oleophilic image on the master, the surface of the master still requires treatment to convert the non-imaged portions of the master from an organophilic surface to a water receptive, ink repellent, lithographic surface in order to enable use of the imaged master in the production of multiple copies by offset or lithographic technique.

It has been found that development of the latent electrostatic image with current liquid developer compositions which contain a toner intended to produce an ink receptive, water repellent, oleophilic image, followed by treatment of the imaged surface with a conversion solution, leaves the image with oleophilic properties which are insufficient from the standpoint of the necessary balance between the oleophilic, ink receptive, water repellent characteristics of the imaged portion and the water receptive, ink repellent, hydrophilic characteristics of the non-imaged portion for use in the production of copies of good quality.

Thus, an offset master imaged with current liquid developers and converted in the usual manner, gives poor density in the copies that are formed, especially at the start of the reproduction process. When an imaged master of the type described is subjected to multiple treatments for conversion or is subjected to over-conversion by the treating solution, the ink receptive imaged portion tends to become blind with the result that ink pick up is poor and copies of unacceptable quality are produced.

A solution to this problem can be approached from a number of directions, such as composition of the conversion solution, composition of the materials formulated to make up the imaged lithographic surface of the master, or the conditions to which the master is exposed during imaging, development of the latent electrostatic image, or conversion and use. The approach that is taken in the practice of this invention resides in the formulation of the developer composition whereby an image is produced on the photoconductive surface of the master, in which the image is characterized by oleophilic properties for rapid ink pick up, whereby copies of good quality can be produced from beginning to end of the copy process, whereby density of the ink picked up by the image is improved for the production of copy of better quality, and whereby multiple conversions or over-conversion with the conversion solution has little, if any, undesirable effect on the ability of the imaged plate to continue to produce copy of good quality, and it is an object of this invention to provide a developer composition capable of producing the desired results.

The objective has been achieved, in accordance with the practice of this invention, by formulation of the liquid developer composition to contain an amine derivative which is effective to improve the oleophilic characteristics of the toned image. The amine derivative can be formulated as a part of the toner or it can be incorporated directly into the developer composition for association with the toner to effect the desired modification of the toner deposited forming the ink receptive, water repellent, oleophilic imaged portion of the offset master.

As the amine derivative use can be made of (1) a fatty acid amine such as bis(2-hydroxyethyl) cocoamine oxide (Aromox DM16T), coconut - acetic acid salts of n-alkyl amines (Armac C), tallow - acetic acid salts of n-alkyl amines (Armac T), octylamine (Armeen 8), hydrogenated tallowamine (Armeen HT), tallowamine (Armeen T), N-tallowtrimethylene diamine diacetate (Duomac T), tertiary amines - ethylene oxide condensation products (Ethomeen C-12), in which the above identified products are marketed by Armak Co.; (2) aliphatic amines in which the aliphatic group has from 3 to 18 carbon atoms such as N-butylamine, N-propylamine, N-hexylamine, octylamine, dodecylamine, methoxypropylamine and di-N-propylamine; (3) aromatic amines such as aniline; and (4) heterocyclic amines such as morpholine, N-ethyl morpholine and N-methyl morpholine.

The following examples will illustrate the practice of this invention in the formulation of liquid developer compositions in which the amine derivative is incorporated in the developer with the toner or as a separate component.

EXAMPLE 1

| Toner Concentrate: % by weight | Ingredients |
|---|---|
| 1.55 | Spirit Nigrosine SSB (Allied Chemical) |
| 3.24 | Carbon Black (Raven 1170 - Columbia Carbon) |
| 0.48 | Alkali Blue R (American Cyanamid) |
| 30.39 | Hercolyn D (Hercules Chemical) |
| 7.15 | Fuel Oil additive #2 (Du Pont) |
| 0.08 | Pliolite VTL (Goodyear) |
| 0.54 | Aromatic 100 (Exxon Co. U.S.A.) |
| 6.87 | Paraffinic Oil 122 (Standard Oil of Indiana) |
| 48.70 | Isopar G (Exxon Co. U.S.A.) |
| 1.0 | N-methyl morpholine |

Procedure

The ingredients are combined to form a toner concentrate, as described in U.S. Pat. No. 3,793,234, after which the N-methyl morpholine is added. 100 Grams of this composition were placed in a ball jar charged with 30 grams of ceramic balls and milled for two hours in a roller mill. For use as a developer composition in the development of a latent electrostatic image formed on an offset master in which the photoconductive layer is formulated of zinc oxide - resinous binder, the concentrate was diluted with Isopar G in the ratio of 6.5 ml of the concentrate per liter of Isopar G.

Offset electrophotographic masters, imaged with the developer composition of Example 1, gave superior copy by comparison with development of a corresponding imaged master with the composition of Example 1, but without the N-methyl morpholine. The improvement was particularly noticeable after multiple treatment of the imaged surface with conventional conversion solution, such as of the type described in U.S. Pat. No. 3,661, 598 or U.S. Pat. No. 3,535,244 where fast inking up of the imaged areas was observed with masters toned with the composition of Example 1 whereas blinding of the image occurred with masters imaged with the same composition in the absence of N-methyl morpholine.

EXAMPLE 2

| Toner Grind: | % by weight |
|---|---|
| Pigment composition: | |
| Nigrosine SSB | 1.66 |
| Carbon Black (Raven 1170) | 3.46 |
| Alkali Blue R | 0.5 |
| Hercolyn D | 37.48 |
| Fuel oil additive #2 | 7.64 |
| N-methyl morpholine | 1.06 |
| Isopar G | 53.2 |
| Toner Concentrate: | |
| Toner grind | 84.88 |
| Pliolite VTL | 0.04 |
| Aromatic 100 | 0.27 |
| Paraffinic oil | 6.29 |
| Isopar G | 8.52 |

The N-methyl morpholine was added to the first four components of the toner grind and the Isopar G was then added and the mixture jar milled in a porcelain jar using ¼ inch steel balls. The ingredients were milled for 64 hours and then formulated into the concentrate with a 5 minute dispersion.

The concentrate was diluted with Isopar G, in the same ratio as in Example 1, for use in development of latent electrostatic images on the photolithographic plate followed by treatment with a standard conversion solution.

The results secured in the production of multiple inked copies by lithographic reproduction from the imaged master were the same as in Example 1.

The Hercolyn D is a hydrogenated methyl ester of rosin which is marketed by Hercules Chemical Company. A wide variety of rosins and rosin derivatives can be used to replace all or part of the Hercolyn D in Examples 1 and 2.

Included are tall oils of rosin as well as their ester and hydrogenated ester derivative. This material serves, at least in part, to disperse the pigment or toner particles in the developer composition. In addition it serves as a charge directing agent and partial fixing agent by forming a thin film which anchors the pigment particles to the surface of the photoconductive coating. The amount of rosin or rosin derivative present in the concentrate may range from 10-40% by weight and preferably 28–38% by weight. In the final liquid developer, the concentration of rosin or derivative will range between 0.02 to 0.08% by weight of the developer composition.

Fuel oil additive #2 is a mixture of 50% by weight methacrylate polymer and 50% by weight kerosene. This material acts as a dispersant or restrainer in order to insure that the toner particles remain in suspension in the concentrate and in the developer composition. As a result, the toner will not tend to settle out, thereby to avoid tailing and agglomeration. Instead of fuel oil additive, use may be made of metal fatty acid soaps such as calcium stearate and the like. When employed, the dispersant or restrainer is employed in an amount within the range of 0.1 to 10% by weight and preferably 3 to 7% by weight of the concentrate and 0.0002 to 0.02% by weight in the developer composition.

The paraffin oil 122 represents a paraffinic oil which operates to produce blacker copy and serves also to minimize settling of the pigment particles in the toner compositions. Instead of a paraffinic oil, use can be made of a naphthenic mineral oil. When present, the oil component is generally employed in an amount up to 10% by weight of the toner concentrate and up to about 0.02% by weight of the developer composition.

Alkali Blue R is a powder marketed by American Cyanamid Company. The material is frequently used as a toning agent to improve the color of the image. Other toning agents, preferably a flushed blue color or an alkali blue, can be used instead of Alkali Blue R in Examples 1 and 2 since they have been found to aid in providing a cleaner background and a denser image.

Isopar G is an aliphatic solvent marketed by the Exxon Co. U.S.A., having a flash point of 104° F and a KB value of about 27. It is desirable to make use of an aliphatic solvent in formulating the toner concentrate and the developer composition in order to maintain the pigment or toner particles in dispersion. Aliphatic ohms-cm, which are used for this purpose should have a high volume resistivity in excess of $10^{10}$ ohns-cm, so as to avoid dissipation of the charge from the electrostatic image. Such aliphatic solvent serves also to avoid attack on the binder in the photoconductive coating.

Pliolite VTL is a modified polyvinyl toluene resin, marketed by Goodyear Rubber Company. Various binders, such as polyvinyl acetate, polyvinyl acetate copolymers, polyvinyl chloride, polystyrene, styrene-butadiene copolymers, alkyd and modified alkyd resins may be used instead of Pliolite VTL in Examples 1 and 2. The binder component may be employed in the developer composition in an amount within the range of 0.00001 to 0.05% by weight.

Any of the amine derivatives, heretofore described, can be substituted in whole or in part for the N-methyl morpholine in Examples 1 and 2, in equivalent amounts. The amine derivative, especially fatty acid amines, aromatic amines or heterocyclic amines, appear to function as charge intensifiers which increase the concentration of toner in the developed image, while imparting greater strength and permanency to the toned oleophilic image that is formed. Thus image density is improved and retained without noticeable undesirable effect from the conversion solution with which the imaged surface is subsequently treated. The desired effect is secured when the amine derivative is employed in the toner concentration in an amount greater than 0.30% by weight but less than 5% by weight, and preferably in an amount within the range of 0.5 to 2.5% by weight. This corresponds to a concentration in the developer composition within the range of 0.0018 to 0.03% by weight and preferably 0.003 to 0.015% by weight.

It will be understood that changes may be made in the details of formulation and operation without departing from the spirit of the invention, especially as defined in the following claims.

We claim:

1. A liquid composition for treatment of the surface of an offset master for development of a latent electrostatic image which is oleophilic, ink receptive, and water repellent, and in which the imaged surface is treated with a conversion solution for rendering the non-imaged portions of the master surface ink repellent, water receptive and hydrophilic, the improvement wherein the liquid composition which, in addition to a water repellent, ink receptive, oleophilic toner, is formulated to contain an amine selected from the group consisting of morpholine, N-ethyl morpholine and N-methyl morpholine.

2. A liquid developer composition as claimed in claim 1 in which the amine is present in the liquid developer in an amount within the range of 0.0018 to 0.03% by weight of the composition.

3. A liquid developer composition as claimed in claim 1 in which the amine is present in the liquid developer in an amount within the range of 0.003 to 0.015% by weight of the composition.

4. A liquid developer composition as claimed in claim 1 in which the liquid developer contains as the major diluent a liquid aliphatic solvent having a resistivity in excess of $10^{10}$ ohms-cm.

5. A liquid developer composition as claimed in claim 1 which contains a rosin or rosin derivative in an amount within the range of 0.02 to 0.08% by weight.

6. A liquid developer composition as claimed in claim 1 which contains a dispersant in an amount within the range of 0.0002 to 0.02% by weight.

7. A liquid developer composition as claimed in claim 1 which contains a resinous binder in an amount within the range of 0.00001 to 0.05% by weight.

8. A liquid developer composition as claimed in claim 1 which contains an oil selected from the group consisting of a paraffinic oil and a mineral oil in which the oil is present in an amount up to 0.02% by weight.

* * * * *

UNITED STATES PATENT OFFICE

CERTIFICATE OF CORRECTION

Patent No. 4,097,391 Dated June 27, 1978

Inventor(s) Elias P. Moschovis & John L. Gilson

It is certified that error appears in the above-identified patent and that said Letters Patent are hereby corrected as shown below:

Column 4, line 24, cancel "ohm-cm" and substitute -- solvents --.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*